US008693941B2

(12) United States Patent
Dangelewicz, Jr. et al.

(10) Patent No.: US 8,693,941 B2
(45) Date of Patent: Apr. 8, 2014

(54) IMAGE FORMING APPARATUS, MEDIA DECURLING SYSTEM USABLE WITH IMAGE FORMING APPARATUS, AND METHOD THEREOF

(75) Inventors: John A Dangelewicz, Jr., San Diego, CA (US); Robert Lockwood, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 416 days.

(21) Appl. No.: 12/900,527

(22) Filed: Oct. 8, 2010

(65) Prior Publication Data

US 2012/0087706 A1 Apr. 12, 2012

(51) Int. Cl.
*G03G 15/00* (2006.01)

(52) U.S. Cl.
USPC ..... 399/406

(58) Field of Classification Search
USPC ..... 399/406; 400/611, 706, 708, 578, 582; 347/104; 271/209, 161, 188
See application file for complete search history.

(56) References Cited

U.S. PATENT DOCUMENTS

| | | | | |
|---|---|---|---|---|
| 4,952,281 | A * | 8/1990 | Akira | 162/270 |
| 5,201,514 | A * | 4/1993 | Rebres | 271/188 |
| 5,392,106 | A | 2/1995 | Bigenwald et al. | |
| 6,895,549 | B1 * | 5/2005 | Albright et al. | 715/247 |
| 2007/0248396 | A1 * | 10/2007 | Blanchard et al. | 400/619 |

FOREIGN PATENT DOCUMENTS

| | | | |
|---|---|---|---|
| JP | 59167450 | A * | 9/1984 |
| JP | 5186116 | | 7/1993 |

* cited by examiner

*Primary Examiner* — Matthew G Marini

(57) ABSTRACT

A method of decurling media supplied by a media supply roll includes determining an amount of media remaining in a form of a media supply roll and forming a media decurling path having a wrap angle around a decurling roller corresponding to at least the amount of the media remaining in the form of the media supply roll.

20 Claims, 8 Drawing Sheets

IMAGE FORMING APPARATUS, MEDIA DECURLING SYSTEM USABLE WITH IMAGE FORMING APPARATUS, AND METHOD THEREOF

BACKGROUND

Image forming apparatuses form images on media. Image forming apparatuses such as high speed printing systems may be supplied with the media in a form of media supply rolls. In such high speed printing systems, the media is transported along a media transport path from the media supply roll to a print zone. In the print zone, images are formed on the media.

BRIEF DESCRIPTION OF THE DRAWINGS

Exemplary non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
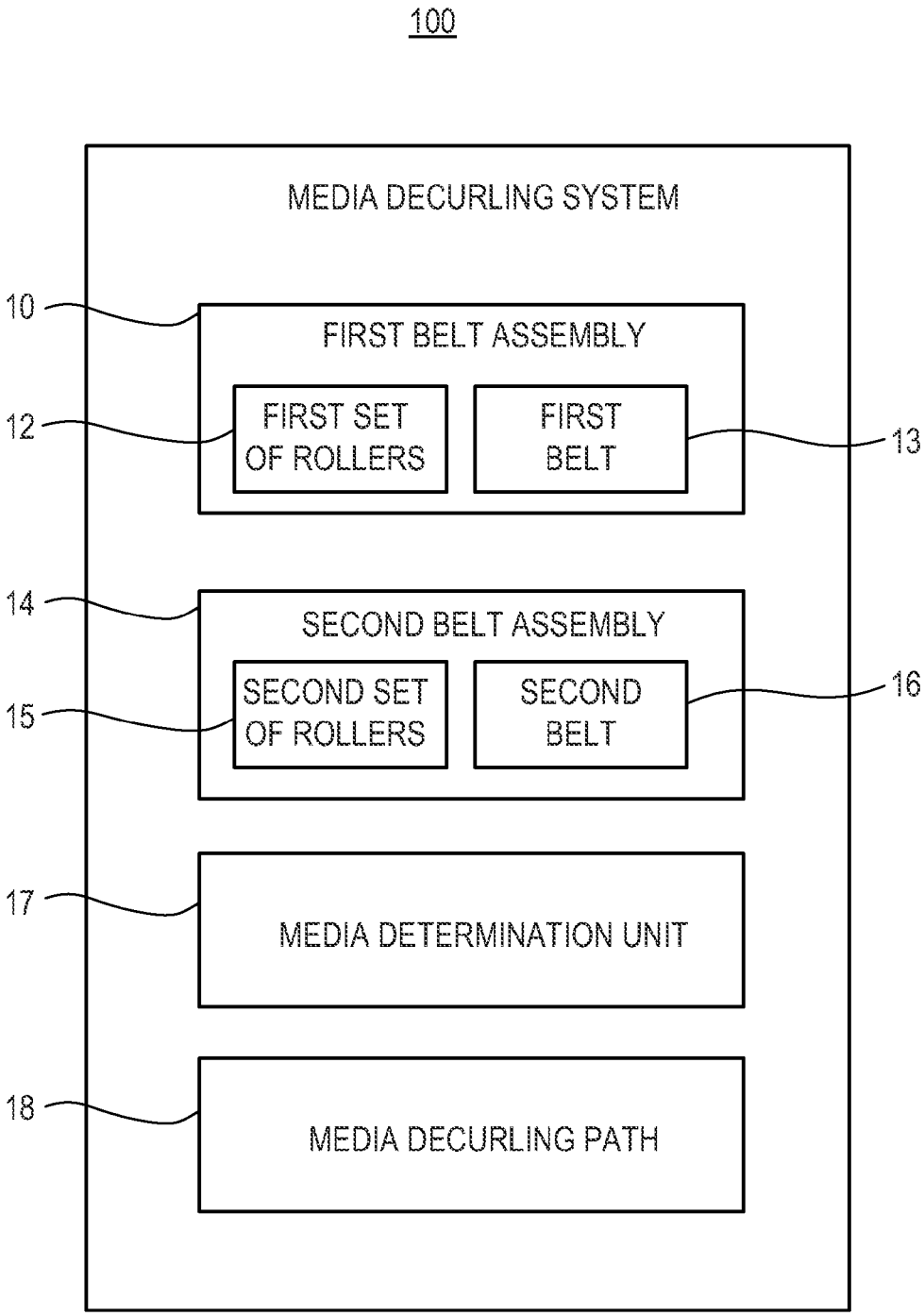
FIG. 1 is a block view illustrating a media decurling system according to an example of the present disclosure.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses form images on media which may be supplied thereto in a form of media supply rolls. The media may be transported along a media transport path to and from a print zone in which images may be formed on the media. The media, however, may retain an amount of roll set curl due to the media being supplied in a form of the media supply roll. Roll set curl, for example, may be a bending and/or curling deformation retained by the media. Such deformation of the media may adversely impact proper operation of the image forming apparatus and/or print quality. Further, the amount of roll set curl of the media may vary with changes to a remaining amount of media of the media supply roll. That is, a decrease in the remaining amount of media of the media supply roll corresponds to a decrease in a radius thereof, resulting in an increase in the amount of roll set curl of the media. Further, the amount of roll set curl may also vary based on the type of media.

The present disclosure is directed to reducing roll set curl of media. This may be accomplished without the use of a roll curl detection sensor. The media decurling path includes a wrap angle formed at predetermined intervals by a first belt assembly moving a distance into a second belt assembly. At each predetermined interval, the respective distance moved by the first belt assembly, and thus, the resulting wrap angle formed, is based on at least the amount of media remaining in the form of the media supply roll. The respective predetermined interval corresponds to the amount of media remaining in the form of the media supply roll and/or the depletion distance of the media transported from the media supply roll. Thus, the respective predetermined interval may be monitored by tracking the depletion distance of the media from the media supply roll. The media decurling path with its respective wrap angle is formed at each of the predetermined intervals. The media decurling path and the resulting wrap angle formed by the respective distance moved by the first belt assembly may also correspond to the type of media. In examples, a subsequent predetermined interval is less than a previous predetermined interval. Thus, compensation for changes to incoming roll set curl may be attained. The media is transported along the media decurling path to reduce the amount of the roll set curl in the media. Further, the media decurling system can also reduce roll set curl in the leading and trailing edges of the media. Accordingly, the reduction of roll set curl of the media in accordance with examples of the present disclosure, aid in the proper operation of the image forming apparatus.

Figure 2:
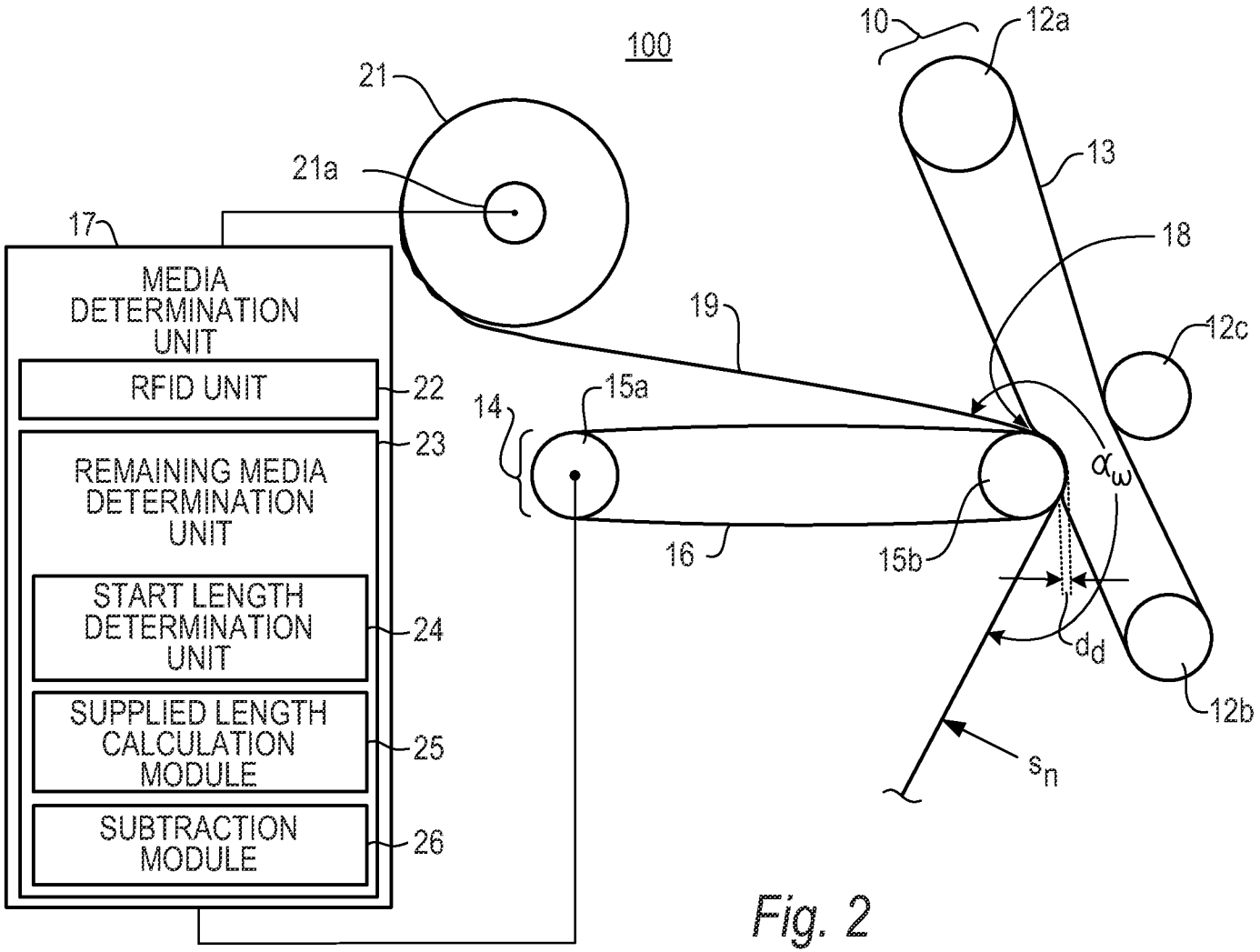
FIG. 2 is a side view illustrating the media decurling system of FIG. 1 according to an example of the present disclosure.

FIG. 1 is a block view illustrating a media decurling system according to an example of the present disclosure. FIG. 2 is a side view illustrating the media decurling system of FIG. 1 according to an example of the present disclosure. Referring to FIG. 1, in the present example, a media decurling system 100 includes a first belt assembly 10, a second belt assembly 14, a media determination unit 17, and a media decurling path 18. As illustrated in FIGS. 1 and 2, the first belt assembly 10 includes a first set of rollers 12 and a first belt 13 rotating about the first set of rollers 12. The second belt assembly 14 includes a second set of rollers 15 and a second belt 16 rotating about the second set of rollers 15. The media determination unit 17 is configured to determine at least an amount of media remaining in a form of a media supply roll 21 (FIG. 2). In examples, the media determination unit 17 may also be configured to determine a type of media. The media decurling path 18 is formed by an intersection of the first belt assembly 10 and the second belt assembly 14.

Figure 3:
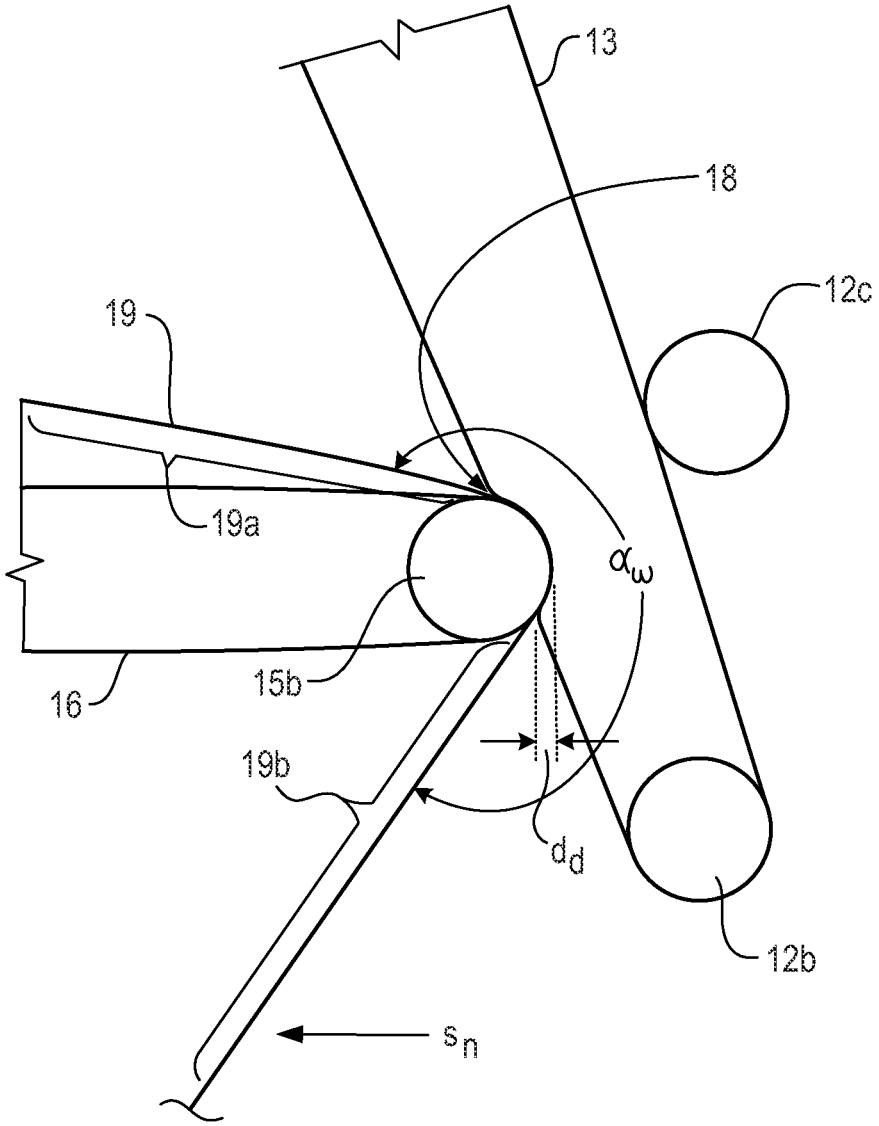
FIG. 3 is an exploded view illustrating a portion of the media decurling system of FIG. 2 according to an example of the present disclosure.

Referring to FIG. 2, in the present example, the second belt assembly 14 is configured to intersect with and selectively move a distance $d_d$, for example, a depth of penetration, into the first belt assembly 10. In an example, the media decurling system 100 may include a rack and pinion drive motor unit (not illustrated) configured to move the second belt assembly 14 into the first belt assembly 10 by the respective distance $d_d$. For example, the rack and pinion drive motor unit may communicate with a media determination unit 17 to obtain the respective distance $d_d$ to move the second belt assembly 14 into the first belt assembly 10. The media decurling path 18 includes a wrap angle $\alpha_w$ around a respective roller 15*b* of the second set of rollers 15 based on the distance $d_d$ moved by the second belt assembly 14 into the first belt assembly 10. That is, the intersection of the first belt 13 and second belt 16 form the media decurling path 18 about the respective roller 15*b* such as a decurling roller 15*b* along which the media is transported. When the media 19 is transported along the media decurling path 18 the media 19 wraps about the respective roller 15*b*. Accordingly, in response to the media 19 wrapping about the respective roller 15*b*, one section 19*a* of the media 19 is upstream from the respective roller 15*b* and an other section 19*b* of the media 19 is downstream from the respective roller 15*b* as illustrated in FIG. 3. Referring to FIG. 3, the wrap angle $\alpha_w$, for example, is an angle formed on a side $s_n$ of the media 19 not facing the respective roller 15*b* by the one section 19*a* and the other section 19*b* of the media 19.

In an example, the distance $d_d$ moved by the second belt assembly 14 into the first belt assembly 10 is based on the determined type of media and the amount of media remaining in the form of the media supply roll 21. That is, various types of media have different degree of susceptibility to roll set curl. For example, double eagle, a stiffer media than distinction media, takes on a greater degree of roll set curl than distinction media. In addition, for each type of media, the susceptibility to roll set curl is greater as less media remains in the form of the media supply roll 21. In an example, an increase in the wrap angle $\alpha_w$ corresponds to a decrease in the amount of media remaining in the form of the media supply roll 21. Thus, as more media 19 is supplied (e.g., depleted) from the media supply roll 21, less media remains in the form of the media supply roll 21. In response to less media remaining in the form of the media supply roll 21, the second belt assembly 14 moves a greater distance $d_d$ into the first belt assembly 10. Consequently, the wrap angle $\alpha$, of the media decurling path 18 is increased. In an example, the roll set curl of the media is reduced by transporting the media 19 along the media decurling path 18 about the decurling roller 15*b* in a direction opposite to the roll set curl, while maintaining no relative motion between the media and the decurling roller 15*b*. That is, the media 19, decurling roller 15*b* and the respective belts 13 and 16 move at the same rate of speed to maintain no relative motion between the respective belts 13 and 16 and media 19. Thus, conditions for the media 19 to be transported in a scratch-free and scuff-free manner are established.

Figure 4:
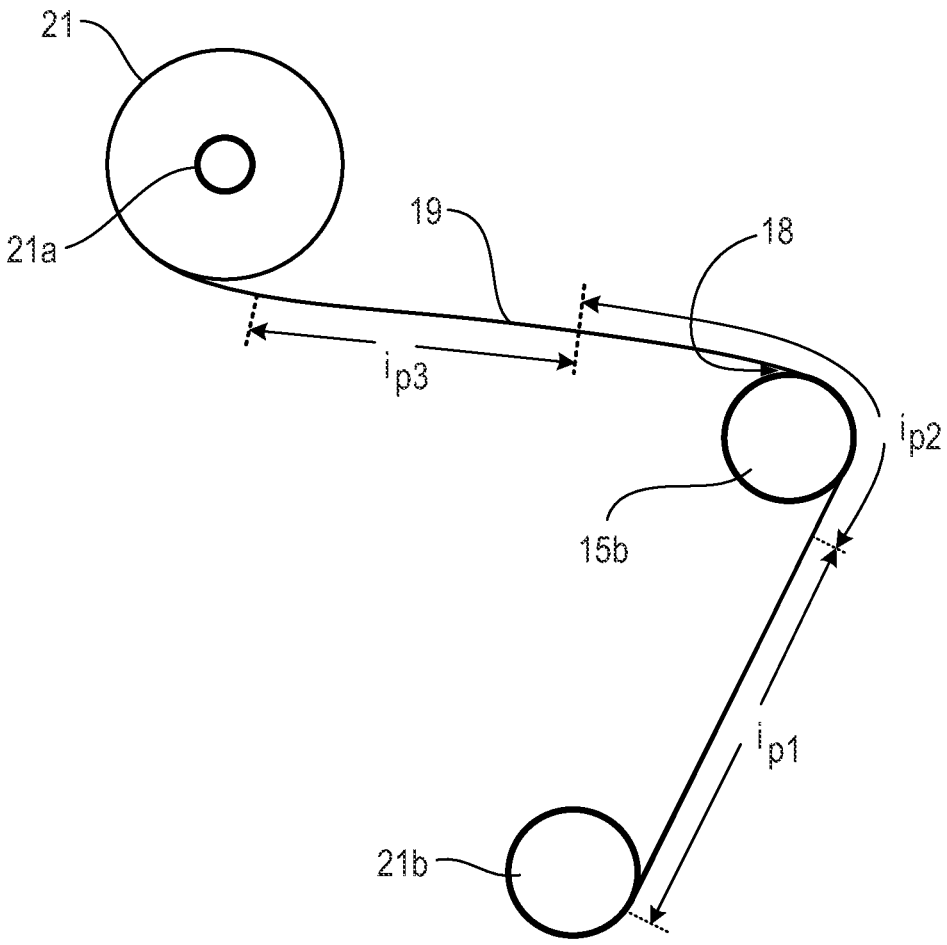
FIG. 4 is a side view of a portion of the media decurling system of FIG. 2 illustrating predetermined intervals according to an example of the present disclosure.

FIG. 4 is a side view of a portion of the media decurling system of FIG. 2 illustrating predetermined intervals according to an example of the present disclosure. Referring to FIG. 4, in an example, the media decurling path 18 is formed at predetermined intervals $i_{p1}$, $i_{p2}$ and $i_{p3}$. The predetermined intervals $i_{p1}$, $i_{p2}$ and $i_{p3}$ correspond to the amount of media remaining in the form of the media supply roll 21 and/or the depletion distance of the media 19 transported (e.g., depleted) from the media supply roll 21. For example, the media remaining in the form of the media supply roll 21 may correspond to an initial amount of media in the form of the media supply roll 21 minus a depletion distance of the media 19 transported from the media supply roll 21. The predetermined intervals $i_{p1}$, $i_{p2}$ and $i_{p3}$ may be monitored by tracking the depletion distance of the media 19 from the media supply roll 21. The media decurling path 18 is formed at each of the predetermined intervals $i_{p1}$, $i_{p2}$ and $i_{p3}$. In the present example, the media decurling path 18 is formed at predetermined intervals $i_{p1}$, $i_{p2}$ and $i_{p3}$ corresponding to a respective length of media 19 (e.g., depletion distances of the media tracked from the media supply roll) supplied from the media supply roll 21 such that the respective length of media 19 decreases for each of the subsequent predetermined intervals.

In an example, the predetermined intervals $i_{p1}$, $i_{p2}$ and $i_{p3}$ may be based on a predetermined percentage of the length of media remaining in the form of the media supply roll 21. For example, if the predetermined percentage is ten percent and an initially full media supply roll 21 includes four hundred linear feet (feet), the first predetermined interval $i_{p1}$ is forty feet of media 19. After forty feet of media 19 is depleted from the media supply roll 21, the media decurling path 18 is formed with a respective wrap angle $\alpha_w$ corresponding to the amount of media remaining in the form of the media supply roll 21. Accordingly, after the first predetermined interval $i_{p1}$, the length of media remaining in the form of the media supply roll 21 is three hundred sixty feet as forty feet of media 19 was previously supplied (e.g., depleted) from the media supply roll 21. Consequently, the second predetermined interval $i_{p2}$ is a subsequent thirty six feet of media 19.

Referring to FIG. 4, after the subsequent thirty six feet of media 19 is depleted from the media supply roll 21, the media decurling path 18 is formed with a respective wrap angle $\alpha_w$ corresponding to the amount of media 19 remaining in the form of the media supply roll 21. In the present example, the respective wrap angle formed after the second predetermined interval $i_{p2}$ is greater than the respective wrap angle formed after the first predetermined interval $i_{p1}$, as less media remains in the form of the media supply roll 21 after the second predetermined interval $i_{p2}$. Accordingly, after the second predetermined interval $i_{p2}$, the length of media remaining in the form of the media supply roll 21 is three hundred twenty four feet as the subsequent thirty six feet of media 19 was previously supplied from the media supply roll 21.

Accordingly, the third predetermined interval $i_{p3}$ is thirty-two feet of media 19, and so on. In other examples, the predetermined percentage may be a variable. For example, the predetermined percentage may incrementally decrease for subsequent predetermined intervals.

Referring to FIG. 2, in an example, the second belt assembly 14 may include at least a second driver roller 15*a*, a decurling roller 15*b*, and a second belt 16 rotating around the second driver roller 15*a* and the decurling roller 15*b*. In an example, the first belt assembly 10 may include at least a first driver roller 12*a*, an idler roller 12*b* and a first belt 13 rotating around the first driver roller 12*a* and the idler roller 12*b*. The first belt assembly 10 may also include a tension adjustment member 12*c* in contact with the first belt 13. The tension adjustment member 12*c* may be configured to maintain tension of the first belt 13 within a predetermined range and apply an amount of force against the first belt 13 based on the distance $d_d$ the second belt assembly 14 moves into the first belt assembly 10.

Figure 5:
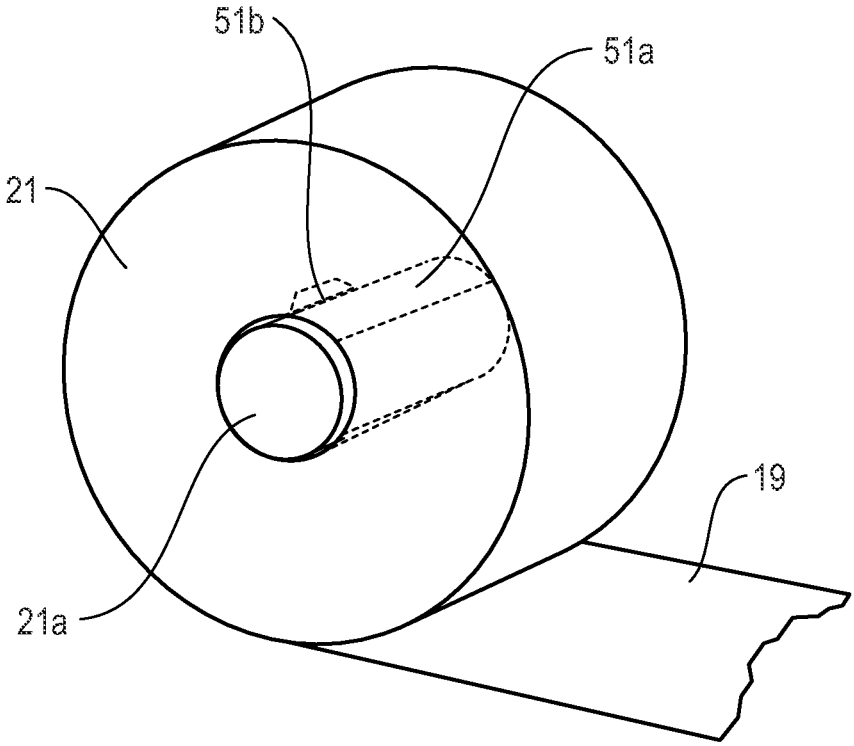
FIG. 5 is a perspective view of the media supply roll of the media decurling system of FIG. 2 according to an example of the present disclosure.

As illustrated in FIG. 2, in an example, the media determination unit 17 may include a radio frequency identification (RFID) unit 22 and a remaining media determination unit 23. The RFID unit 22 may be configured to read a RFID tag 51*b* (FIG. 5) to determine at least the type of media. In an example, the RFID unit 22 may be a sensor 51*a* (FIG. 5) disposed to access the RFID tag 51*b*. For example, the sensor 51*a* may be disposed on a feed roller 21*a* as illustrated in FIG. 5. In an example, the media determination unit 17 may also include and/or access a lookup table with curl susceptibility factors for each type of media. Each curl susceptibility factor will include a numeric value corresponding to a degree of susceptibility of the respective media to roll set curl. Referring to FIG. 5, the RFID tag 51*b* may be disposed on the media in a manner to be accessible to the RFID unit 22. For example, the RFID tag 51*b* may be disposed on an inner diameter of the media supply roll 21 to be removably received by the feed roller 21*a*. The remaining media determination unit 23 may be configured to determine an amount of media remaining in the form of the media supply roll 21. For example, the remaining media determination unit 23 may include a start length determination module 24, a supplied length calculation module 25, and a subtraction module 26.

Referring to FIG. 2, the start length determination module 24 may be configured to determine a starting length of media in the form of the media supply roll 21. For example, in the previous example, the starting length of the initial media supply roll 21 was four hundred feet. In an example, information such as the initial length of a full media supply roll 21 may be obtained from an RFID tag 51*b* (FIG. 5), memory, or the like. Subsequent starting lengths correspond to the remaining amount of media in the form of the media supply, after a respective length of media 19 corresponding to the previous predetermined interval is supplied from the media supply roll 21. Thus, in the previous example, after the first predetermined interval $i_{p1}$, the starting length of the media supply roll 21 is three hundred sixty feet of media.

Referring to FIG. 2, the supplied length calculation module 25 may be configured to calculate a length of media supplied from the media supply roll 21. In an example, the length of media supplied corresponds to a respective predetermined interval $i_{p1}$, $i_{p2}$ and $i_{p3}$. For example, in the previous example, the supplied length corresponding to the first predetermined interval $i_{p1}$ is forty feet of media 19, the supplied length corresponding to the second predetermined interval $i_{p2}$ is thirty-six feet of media 19, and so on. In an example, the supplied length calculation module 25 may count encoder units (not illustrated) from the feed roller 21*a* and/or motor (not illustrated) to determine the length of media 19 supplied from the media supply roll 21.

Referring to FIG. 2, the subtraction module 26 may be configured to subtract the calculated length of media 19 supplied from the media supply roll 21 from the determined starting length of media to obtain the length of media remaining in the form of the media supply roll 21. In the previous example, after the first predetermined interval $i_{p1}$, the subtraction module 26 determines the length of media remaining in the media supply roll 21 to be three hundred sixty feet of media by subtracting forty feet from four hundred feet, and so on. In examples, the media determination unit 17 may be implemented in hardware, software, or in a combination of hardware and software. Accordingly, the media determination unit 17 may be implemented, in whole or in part, as a computer program stored in media decurling system 100 and/or the image forming apparatus 601 locally such as in firmware or remotely, for example, in a server or a host computing device.

Figure 6:
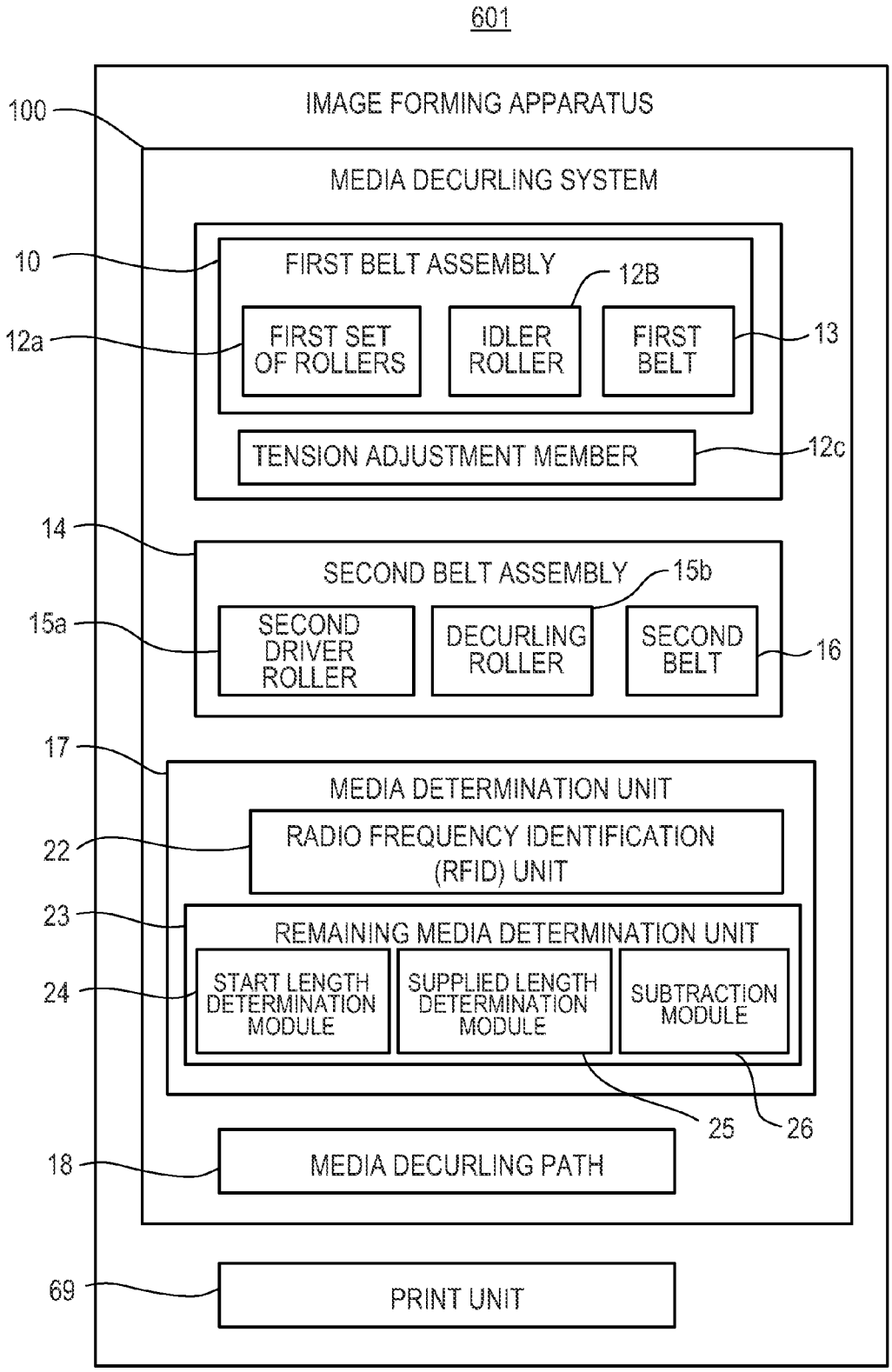
FIG. 6 is a block view illustrating an image forming apparatus according to an example of the present disclosure.
Figure 7:
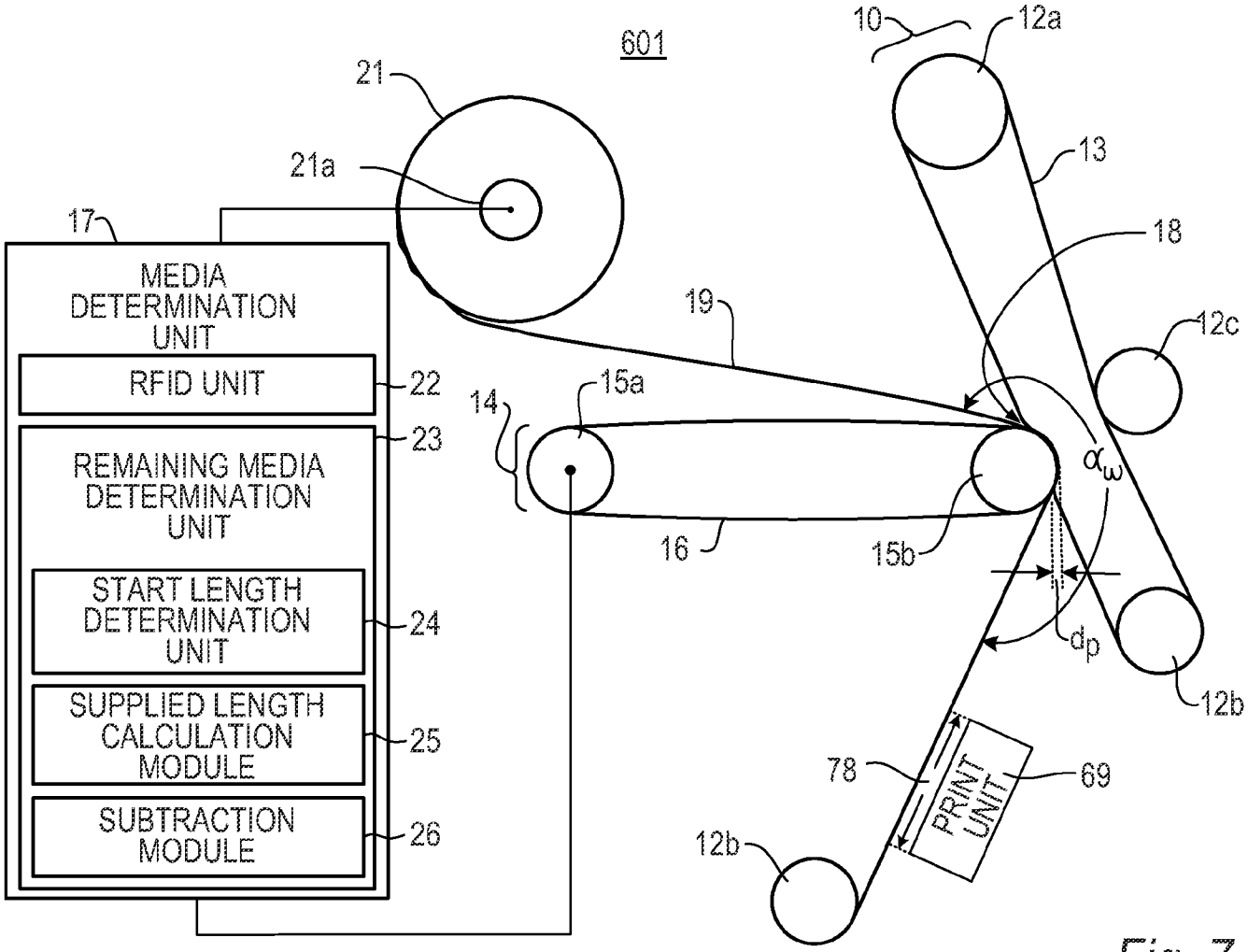
FIG. 7 is a side view illustrating the image forming apparatus of FIG. 6 according to an example of the present disclosure.

FIG. 6 is a block view illustrating an image forming apparatus according to an example of the present disclosure. FIG. 7 is a side view of a portion of the image forming apparatus of FIG. 6 according to an example of the present disclosure. FIG. 7 is similar to the media decurling system 100 illustrated in FIG. 2 with the addition of a print unit 69, print zone 78 and output roller 21*b*. Referring to FIG. 6, in the present example, the image forming apparatus 601 includes a media decurling system 100 and a print unit 69. The media decurling system 100 includes a first belt assembly 10, a second belt assembly 14, a media determination unit 17 configured to determine a type of media and an amount of media remaining in a form of a media supply roll 21, and a media decurling path 18 formed by an intersection of the first belt assembly 10 and the second belt assembly 14 at predetermined intervals $i_{p1}$, $i_{p2}$ and $i_{p3}$ in which a subsequent predetermined interval is less than a previous predetermined interval.

Referring to FIG. 7, in the present example, the first belt assembly 10 includes a first driver roller 12*a*, an idler roller 12*b*, and a first belt 13 rotating about the first driver roller 12*a* and the idler roller 12*b*. The second belt assembly 14 includes a second driver roller 15*a*, a decurling roller 15*b*, and a second belt 16 rotating about the second driver roller 15*a* and the decurling roller 15*b*. The second belt assembly 14 is configured to intersect with the first belt assembly 10 and change a depth of penetration $d_p$ of the second belt assembly 14 into the first belt assembly 10. The media decurling path 18 forms a wrap angle $\alpha_w$ about the decurling roller 15*b* based on the depth of penetration $d_p$ of the second belt assembly 14 into the first belt assembly 10.

In an example, the depth of penetration $d_p$ is based on the determined type of media and the amount of media remaining in the form of the media supply roll 21. Accordingly, an increase in the wrap angle $\alpha_w$ formed by the media decurling path 18 about the decurling roller 15*b* corresponds to at least a decrease in the amount of media remaining in the form of the media supply roll 21. In an example, the media decurling system 100 also includes the media determination unit 17 and the tension adjustment member 12*c* as previously discussed and illustrated in FIG. 2.

Referring to FIG. 7, in the present example, the print unit 69 is disposed adjacent to a print zone 78 and configured to print an image on the media 19 transported to the print zone 78. For example, the print unit 69 may be one or more inkjet print heads, or the like. The print unit 69 is disposed downstream of the media decurling path 18. Thus, decurling of the media 19 can be performed prior to the media being disposed in the print zone 78 to be printed on. An output roller 21*b* may receive the media 19 supplied from the feed roller 21*a*. In an example, the feed roller 21*a* and the output roller 21*b* may also assist in providing tension to the media 19.

Figure 8:
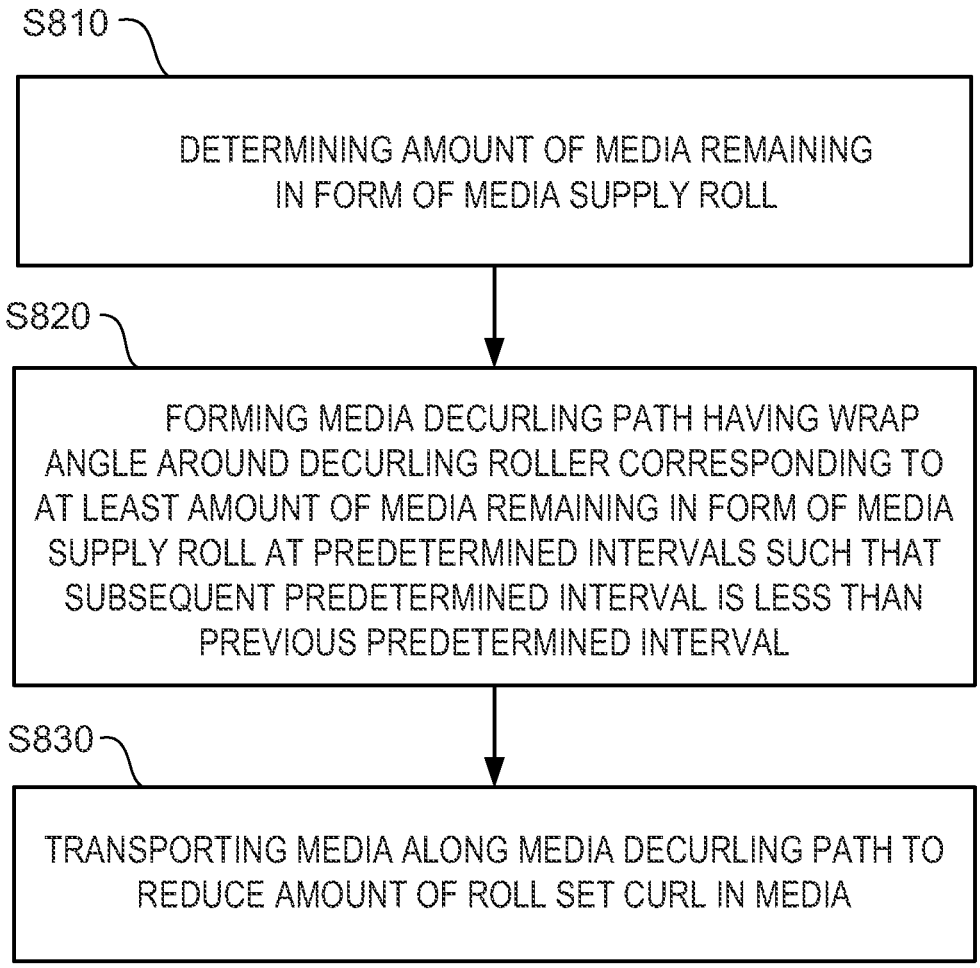
FIG. 8 is a flowchart illustrating a method of decurling media supplied by a media supply roll according to an example of the present disclosure.

FIG. 8 is a flowchart illustrating a method of decurling media supplied by a media supply roll according to an example of the present disclosure. Referring to FIG. 8, in block S810, an amount of media remaining in a form of a media supply roll is determined. In an example, the amount of media remaining in a form of a media supply roll may be determined by determining a starting length of media in the form of the media supply roll, calculating a length of media supplied (e.g., depleted) from the media supply roll and subtracting the calculated length of media supplied from the media supply roll from the determined starting length of media to obtain the length of media remaining in the form of the media supply roll.

Referring to FIG. 8, in block S820, a media decurling path having a wrap angle around a decurling roller is formed corresponding to at least the amount of the media remaining in the form of the media supply roll at predetermined intervals such that a subsequent predetermined interval is less than a previous predetermined interval. In an example, each of the predetermined intervals may correspond to a respective length of media supplied from the media supply roll such that the respective length of media decreases for each of the subsequent predetermined intervals. The predetermined intervals may be monitored by tracking the depleted distance of the media transported from the media supply roll. In an example, the wrap angle around the decurling roller may also correspond to a type of media identified by radio frequency identification. For example, the types of media may include double eagle media and distinction media.

Referring to FIG. 8 and block S820, in an example, a media decurling path having a wrap angle around a decurling roller may be formed by moving a second belt assembly a distance into or away from a first belt assembly based on the amount of the media remaining on the media supply roll to form the media decurling path. Accordingly, the wrap angle of the media decurling path formed may be based on the distance moved by the second belt assembly. The first belt assembly may include at least a first driver roller, an idler roller and a first belt rotating around the first driver roller and the idler roller. The second belt assembly may include at least a second driver roller, a decurling roller, and a second belt rotating around the second driver roller and the decurling roller.

Referring to FIG. 8, in block S830, the media is transported along the media decurling path to reduce an amount of roll set curl in the media. In an example, the transporting of the media along the media decurling path may include transporting the media along the media decurling path about the decurling roller in a direction opposite to the roll set curl, while maintaining no relative motion between the media and the decurling roller. The method of decurling media may also include maintaining a predetermined tension in the first belt assembly in response to the moving of the second belt assembly into or away from the first belt assembly.

The present disclosure has been described using non-limiting detailed descriptions of examples thereof. Such examples are not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A method of decurling media supplied by a media supply roll, the method comprising:

determining an amount of media remaining in a form of a media supply roll;

forming a media decurling path having a wrap angle around a decurling roller corresponding to at least the amount of the media remaining in the form of the media supply roll at predetermined intervals such that a subsequent predetermined interval is less than a previous predetermined interval; and transporting the media along the media decurling path to reduce an amount of roll set curl in the media, the media decurling path formed by a first belt assembly including a first belt rotating about a first pair of rollers and a second belt assembly including a second belt rotating about a second pair of rollers, a second axis extending between and through the second pair of rollers intersecting, within a path of the first belt, a first axis extending between and through the first pair of rollers, the second belt having first and second unsupported lengths each extending directly between the second pair of rollers.

2. The method according to claim 1, wherein each of the predetermined intervals corresponds to a respective length of media supplied from the media supply roll such that the respective length of media decreases for each of the subsequent predetermined intervals.

3. The method according to claim 1, wherein determining an amount of media remaining in a form of a media supply roll comprises:

determining a starting length of media in the form of the media supply roll;

calculating a length of media supplied from the media supply roll; and subtracting the calculated length of media supplied from the media supply roll from the determined starting length of media to obtain the length of media remaining in the form of the media supply roll.

4. The method according to claim 1, wherein forming a media decurling path having a wrap angle around a decurling roller corresponding to at least the amount of the media remaining in the form of the media supply roll comprises:

moving the second belt assembly a distance into or away from the first belt assembly based on the amount of the media remaining on the media supply roll to form the media decurling path; and forming the wrap angle of the media decurling path based on the distance moved by the second belt assembly.

5. The method according to claim 4, wherein:

the first pair of rollers of the first belt assembly includes a first driver roller and an idler roller, with the first belt rotating around the first driver roller and the idler roller; and the second pair of rollers of the second belt assembly includes a second driver roller and a decurling roller, with the second belt rotating around the second driver roller and the decurling roller.

6. The method according to claim 5, wherein transporting the media along the media decurling path to reduce the amount of roll set curl of the media comprises:

transporting the media along the media decurling path about the decurling roller in a direction opposite to the roll set curl while maintaining no relative motion between the media and the decurling roller.

7. The method according to claim 4, further comprising:

maintaining a predetermined tension in the first belt assembly in response to the moving of the second belt assembly into or away from the first belt assembly.

8. The method according to claim 1, wherein the wrap angle around the decurling roller corresponds to a type of media identified by radio frequency identification.

9. A media decurling system usable with an image forming apparatus, the media decurling system comprising:

a first belt assembly including a first set of rollers, a first axis extending between and through the first set of rollers, and a first belt rotating about the first set of rollers;

a second belt assembly including a second set of rollers, a second axis extending between and through the second set of rollers, and a second belt rotating about the second set of rollers, the second axis of the second belt assembly configured to intersect with the first axis of the first belt assembly within a path of the first belt of the first belt assembly, the second belt having a first length extending in a first direction directly between the second set of rollers and a second length extending in a second direction opposite the first direction directly between the second set of rollers, and the second belt assembly configured to selectively move a distance into the first belt assembly;

a media determination unit configured to determine a type of media and an amount of media remaining in a form of a media supply roll; and a media decurling path formed by an intersection of the first belt assembly and the second belt assembly, the media decurling path having a wrap angle around a respective roller of the second set of rollers based on the distance moved by the second belt assembly into the first belt assembly, wherein the distance moved is based on the determined type of media and the amount of media remaining in the form of the media supply roll.

10. The system according to claim 9, wherein:

the media decurling path is formed at predetermined intervals corresponding to a respective length of media supplied from the media supply roll such that the respective length of media decreases for each of the subsequent predetermined intervals; and an increase in the wrap angle corresponds to a decrease in the amount of media remaining in the form of the media supply roll.

11. The system according to claim 9, wherein the media determination unit comprises:

a radio frequency identification unit configured to read a radio frequency identification tag to determine the type of media; and a remaining media determination unit configured to determine the amount of media remaining in the form of the media supply roll.

12. The system according to claim 11, wherein the remaining media determination unit further comprises:

a start length determination module configured to determine a starting length of media in the form of the media supply roll;

a supplied length calculation module configured to calculate a length of media supplied from the media supply roll; and a subtraction module configured to subtract the calculated length of media supplied from the media supply roll from the determined starting length of media to obtain the length of media remaining in the form of the media supply roll.

13. The system according to claim 9, wherein:

the first set of rollers of the first belt assembly includes a first driver roller and an idler roller, with the first belt rotating around the first driver roller and the idler roller, and the first axis extending between and through the first driver roller and the idler roller; and the second set of rollers of the second belt assembly includes a second driver roller and a decurling roller, with the second belt rotating around the second driver roller and the decurling roller, and the second axis extending between and through the second driver roller and the decurling roller.

14. The system according to claim 13, wherein the first belt assembly further comprises:

a tension adjustment member in contact with the first belt, the tension adjustment member configured to maintain tension of the first belt within a predetermined range and apply an amount of force against the first belt based on the distance the second belt assembly moves into the first belt assembly.

15. An image forming apparatus usable with a media supply roll, the image forming apparatus comprising:

a media decurling system, including:

a first belt assembly including a first driver roller, an idler roller, a first axis extending between and through the first driver roller and the idler roller, and a first belt rotating about the first driver roller and the idler roller;

a second belt assembly including a second driver roller, a decurling roller, a second axis extending between and through the second driver roller and the decurling roller, and a second belt rotating about the second driver roller and the decurling roller, the second axis of the second belt assembly configured to intersect with the first axis of the first belt assembly within a path of the first belt of the first belt assembly, the second belt of the second belt assembly having first and second unsupported lengths each extending directly between the second driver roller and the decurling roller, and the second belt assembly configured to change a depth of penetration of the second belt assembly into the first belt assembly;

a media determination unit configured to determine a type of media and an amount of media remaining in a form of a media supply roll; and a media decurling path formed by an intersection of the first belt assembly and the second belt assembly at predetermined intervals such that a subsequent predetermined interval is less than a previous predetermined interval, the media decurling path forming a wrap angle about the decurling roller based on the depth of penetration of the second belt assembly into the first belt assembly; and a print unit disposed downstream of the media decurling path and adjacent to a print zone, the print unit configured to print an image on the media disposed in the print zone.

16. The system according to claim 15, wherein each of the predetermined intervals corresponds to a respective length of media supplied from the media supply roll such that the respective length of media decreases for each of the subsequent predetermined intervals.

17. The system according to claim 15, wherein:

the depth of penetration is based on the determined type of media and the amount of media remaining in the form of the media supply roll; and an increase in the wrap angle formed by the media decurling path about the decurling roller corresponds to a decrease in the amount of media remaining in the form of the media supply roll.

18. The system according to claim 15, wherein the media determination unit comprises:

a radio frequency identification unit configured to read a radio frequency identification tag to determine the type of media; and a remaining media determination unit configured to determine the amount of media remaining in the form of the media supply roll.

19. The system according to claim 18, wherein the remaining media determination unit further comprises:

a start length determination module configured to determine a starting length of media in the form of the media supply roll;

a supplied length calculation module configured to calculate a length of media supplied from the media supply roll; and a subtraction module configured to subtract the calculated length of media supplied from the media supply roll from the determined starting length of media to obtain the length of media remaining in the form of the media supply roll.

20. The system according to claim 15, wherein the first belt assembly further comprises:

a tension adjustment member in contact with the first belt, the tension adjustment member configured to maintain tension of the first belt within a predetermined range.

* * * * *